United States Patent [19]

Whitaker

[11] 4,033,717

[45] July 5, 1977

[54] METHOD OF PRODUCING MULTICOLORED YARN, AND YARN AND CARPET MADE THEREBY

[75] Inventor: Ralph Whitaker, Bala Cynwyd, Pa.

[73] Assignee: Fred Whitaker Company, Bala-Cynwyd, Pa.

[22] Filed: Oct. 6, 1975

[21] Appl. No.: 619,631

[52] U.S. Cl. ..... 8/14; 8/15; 8/148; 8/149; 28/169; 28/247; 28/279

[51] Int. Cl.[2] ..... D06P 5/00; D06P 7/00

[58] Field of Search ..... 8/14, 15, 74 P; 28/72.16, 75 R

[56] References Cited

UNITED STATES PATENTS

| | | | |
|---|---|---|---|
| 3,012,303 | 12/1961 | Whitaker et al. | 28/72 |
| 3,102,322 | 9/1963 | Whitaker | 28/72 |
| 3,934,971 | 1/1976 | Blanchard et al. | 8/14 |

*Primary Examiner*—John Kight, III

[57] ABSTRACT

Drawn but undyed synthetic continuous filament yarn is formed into a prefabric, selected portions of the prefabric are dyed while leaving other selected portions free of any dye, the prefabric is raveled, the resulting partially dyed yarn is formed into a partially dyed prefabric, and this partially dyed prefabric is then substantially completely over-dyed to produce a novel over-dyed fabric.

This method produces a novel form of crimped and drawn continuous filament synthetic polymeric yarn, a substantial portion of which is undyed, and the balance of which consists of random, intermittent dyed lengths consisting of at least two different colors (A and B) intermittently and randomly arranged along the length of the yarn.

When such yarn is formed into a tufted pile carpet, a unique product is provided having a base to which are anchored a plurality of upstanding piles of yarn, which tufts have colors uniquely arranged in the form of randomly shaped coherently colored areas wherein the individual colors appear as individual blocks, and wherein such blocks are randomly shaped and randomly grouped on the carpet.

29 Claims, 10 Drawing Figures

METHOD OF PRODUCING MULTICOLORED YARN, AND YARN AND CARPET MADE THEREBY

BACKGROUND OF THE INVENTION

This invention relates to a method of making a novel, intermittently dyed yarn, to the yarn thus produced, and to fabrics made therefrom, and has particular reference to the production of tufted pile carpets composed of drawn synthetic continuous filament yarn, which carpet can be conveniently mass produced and stored in a partially dyed condition, and which can be subjected to subsequent batch over-dyeing in a manner to provide a finished carpet of any desired color choice.

In the production of carpets composed of the well known "spacedyed" yarns, such as yarns produced in accordance with my issued U.S. Pat. No. 3,012,303, granted Dec. 12, 1961 and U.S. Pat. No. 3,102,233, granted Sept. 3, 1963, it has been conventional to form the drawn and crimped continuous filament yarn into a prefabric such as knitted tubing, for example, and to pad dye the tubing with an overall basic color. This wall followed by spacedyeing in which selected areas of the tubing were printed with different colors, following which the prefabric was dyed and the dye heat-set. The prefabric was then deknitted and wound onto cones or beams. Subsequently, the yarn was subjected to a carpet tufting operation in order to produce a multicolored tufted carpet. Such a multicolored tufted carpet was completely dyed, and the basic pad dyed color was clearly visible in the tufts of the fabric, along with the additional colors that had been added to the knitted prefabric by the spacedyeing procedure.

In accordance with conventional procedures, it has been considered necessary to produce the resulting carpets in a wide variety of colors, such as 12 to 18, for example. Thus in the warehousing of such carpets prior to sale to the ultimate customers, it has been necessary to maintain a very large inventory, such inventory containing a representative quantity of carpet of each such preselected color combination, so that each particular color combination would be available when selected or ordered by the customer. This, of course, greatly increased the ultimate cost of the carpet, because of the substantial expense of warehousing space, and because of other warehousing and inventory costs.

It is accordingly an object of this invention to provide a method, a yarn and a carpet which is drastically reduce the cost of warehousing and inventorying large numbers of different colors and different color combinations of carpets, without sacrificing the ability to provide such a wide variety of colors and color combinations to the customer upon reasonable notice.

It is still another object of this invention to provide a carpet making method, a carpet yarn and a carpet product which can be inventoried in only one color combination, and from which a wide variety of different color combinations may be made in a reasonable period of time, and at a reasonable cost.

Other objects and advantages of this invention will appear in further detail hereinafter, and in the drawings, of which:

DESCRIPTION OF A PREFERRED EMBODIMENT

Figure 1:
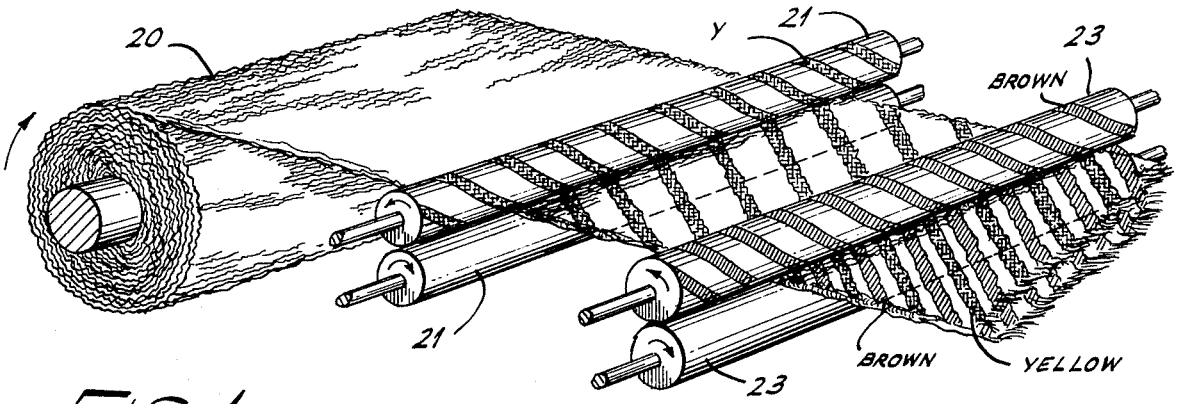
FIG. 1 is a view in perspective illustrating spacedyeing as applied to a prefabric in accordance with this invention.

Although specific forms of the invention have been selected for illustration in the drawings, and the following description is drawn in specific terms for the purpose of describing those forms of the invention, this description is not intended to define or to limit the scope of the invention, which is defined in the appended claims.

Referring now to the drawings, FIG. 1 shows a prefabric 20, preferably in the form of dry knitted tubing, which may be any other kind of prefabric which is subject to subsequent raveling in order to liberate the yarn as an individual strand therefrom. This prefabric 20, here shown as being rolled up, is unrolled in the direction indicated by the arrow and is fed continuously between an initial pair of spacedyeing printing rolls 21, 21. As shown, these rolls are adapted to print upon the prefabric a multiplicity of spaced apart stripes 22 of a predetermined color.

Downstream in the direction of movement of the prefabric 20 is another pair of spacedyeing rolls 23, 23. In this case, the rolls 23, 23 are shown as having the capability of sapcedyeing alternate stripes of different colors. For example, it may be assumed that brown dye is fed to the portions of the upper roll 23 identified by the letter B, and that yellow dye is fed to the portions of the upper roll 23 designated by the letter Y. In this manner, alternate stripes of brown and yellow are applied to the prefabric by the rolls 23, 23, in addition to such other color as is applied by the spacedyeing rolls 21, 21. Accordingly, it will be apprecuated that in this manner two, three or even more individual colors may be printed in the form of stripes or any other desired design, upon the prefabric as its passes through and between one or more sets of spacedyeing rolls.

It should be pointed out that the initial yarn of which the dry knitted prefabric tubing 20 is made is a crimped and drawn continuous filament synthetic polymeric yarn, which is undyed. Thus, the dry knitted prefabric tubing 20 is also undyed, until such time as it is contacted by one or more spacedyeing rolls. Also, it is important to observe that the widths of the bands of the spacedyeing rolls are carefully predetermined so that at least about 20%, and preferably at least about 40% of the exposed surface area of the dry knitted tubing 20 is undyed. This is an important and advantageous feature of this invention, as will further become apparent hereinafter.

Figure 2:
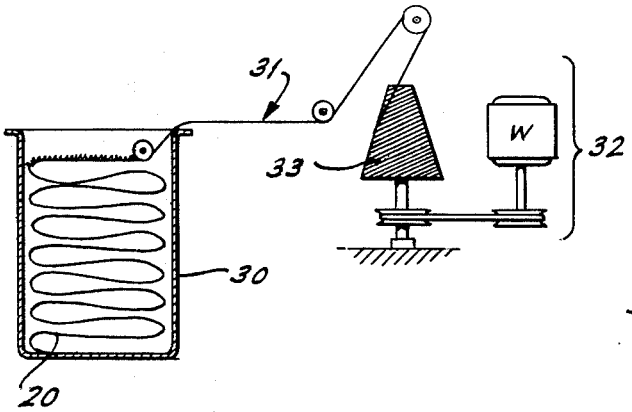
FIG. 2 represents schematically a deknitting step which is another step of the method in accordance with this invention.

FIG. 2 shows a subsequent step in the method. The prefabric tubing 20 is shown as arranged in a container 30, and the individual strand of yarn 31 is being continuously raveled therefrom by a winder 32 which continuously winds the yarn 31 onto a package 33. Although the prefabric may be of any structure which admits of raveling a single end of yarn therefrom, a knitted structure is preferred because of the ease with which deknitting may be accomplished, as shown in FIG. 2.

Figure 3:
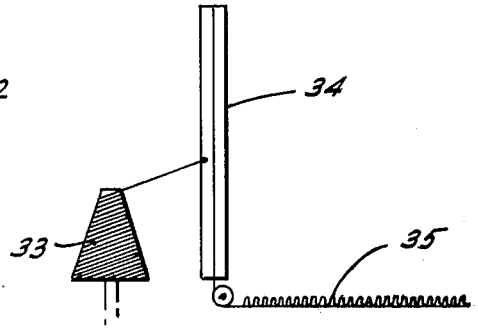
FIG. 3 represents a carpet tufting procedure which comprises another step in accordance with one embodiment of this invention.

FIG. 3 shows a subsequent step of the method, wherein the yarn 31 from yarn cone 33 is fed into a carpet tufting loom 34, the structural details of which are well known, are not per se of this invention, and are not shown in the drawings. Loom 34 utilizes a base or substrate to which the yarn 31 is tufted. Any form of conventional carpet tufting loom may be used. The tufts may, of course, be cut or uncut. The tufted pre-carpet is identified by the number 35.

It will be appreciated that, since the yarn 31 was only partially dyed, and included substantial undyed portions along its length, the tufted pre-carpet 35 itself includes the same undyed portions, as will be described in further detail hereinafter.

Figure 4:
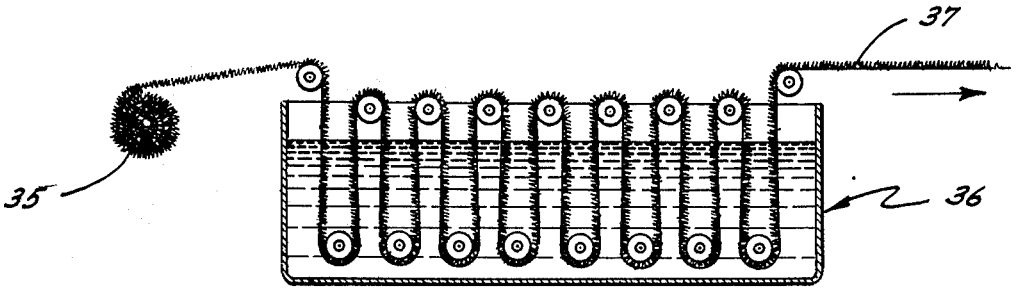
FIG. 4 represents schematically an over-dyeing step which comprises still another step in a method according to this invention.

FIG. 4 shows a subsequent step of the method, wherein the entire tufted pre-carpet 35 is over-dyed by passing it through a dye bath 36, to produce a tufted finished carpet 37. Dye bath 36 may be any conventional form of dye bath, batch or continuous, and may comprise a dye vat such as a Beck dye vat, a dye pad, a solid screen printing apparatus or any other means for applying color to the entire surface of the tufted pre-carpet 35.

Figure 5:
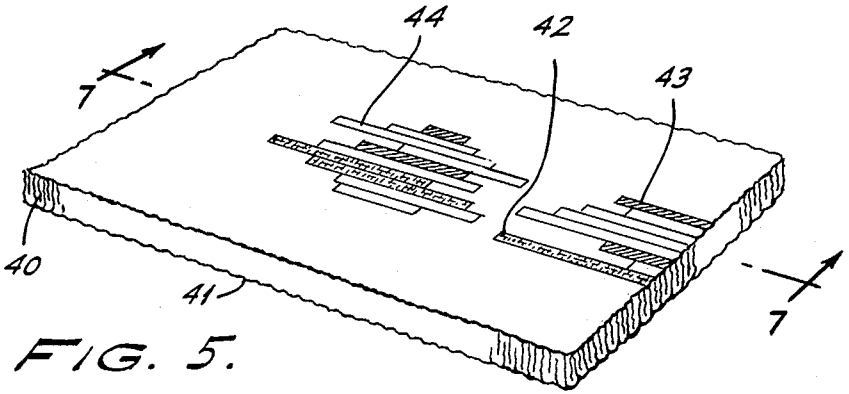
FIG. 5 is a view in perspective of a tufted carpet sample illustrating important features of this invention.

FIG. 5 shows a piece of tufted pre-carpet 35 before over-dyeing. Surprisingly the alternate lengths of dyed and undyed portions in the yarn do not produce a "pepper-and-salt" effect in the pre-carpet, but instead produce tufts which are anchored to the base 41 in the form of randomly patterned areas in which different colored areas and undyed areas are arranged in random shapes, each coherently colored. For example, the areas 42 may be yellow, the areas 43 brown and the areas 44 undyed and therefore having a snow-white appearance. The shapes of the individual areas are random, though they are related to the relative lengths of dyed and undyed portions of the yarn 31 from which the tufted pre-carpet 35 was made, and are related also the tuft lengths, as will further become apparent hereinafter.

Figure 6:
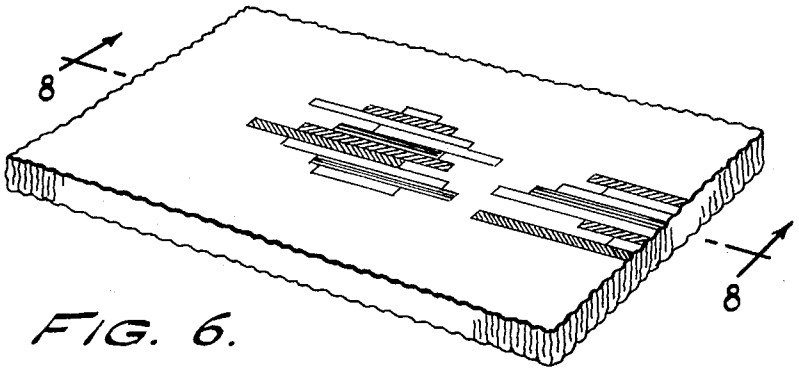
FIG. 6 is a view similar to FIG. 5 of a tufted carpet sample, after over-dyeing it in accordance with this invention.

FIG. 6 shows the finished carpet of FIG. 5 after over-dyeing in which the entire carpet was subjected to dyeing with a single color. The over-dyeing step, of course, applies the selected over-dyeing color to the previously undyed areas 44 but the over-dye interacts with the previously dyed areas 43, 44 to produce predetermined color mutations. For example, an over-dye of blue tends to mutate the yellow areas 42 to green and the brown areas 43 to a dark brownish black color. Many dye colors may be preselected for brown mutation results.

Figure 7:
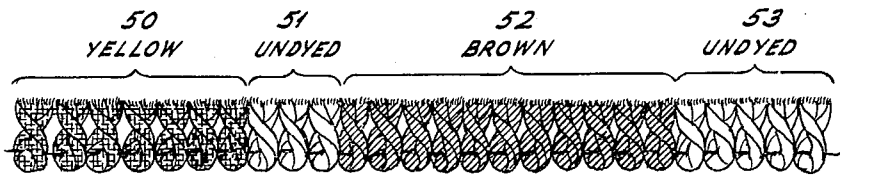
FIG. 7 is a sectional view taken as indicated by the lines and arrows VII—VII which appear in FIG. 5.
Figure 8:
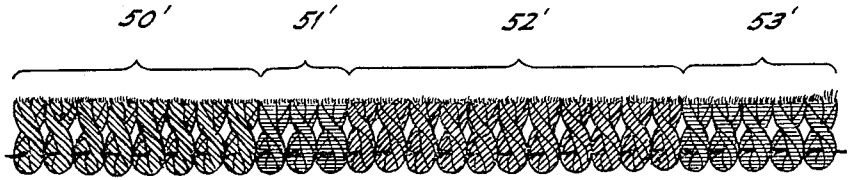
FIG. 8 is a sectional view taken as indicated by the lines and arrows VIII—VIII which appear in FIG. 6.

FIGS. 7 and 8 are sectional views showing the nature of a single row of successive tufts 40. Because of the considerable length of each color section along the yarn 31, from which the tufts 40 were made, several sequential and adjacent tufts 40 tend to exhibit the same color. For example, in FIG. 7, the group 50 may be yellow, the group 51 undyed, the group 52 brown, and the group 53 undyed. Correspondingly, after over-dyeing with a blue color, the tuft groups in FIG. 8 comprise group 50′ which is green, group 51′ which is blue, group 52′ which is dark brownish black, group 53′ which is blue, and so on.

Figure 9:
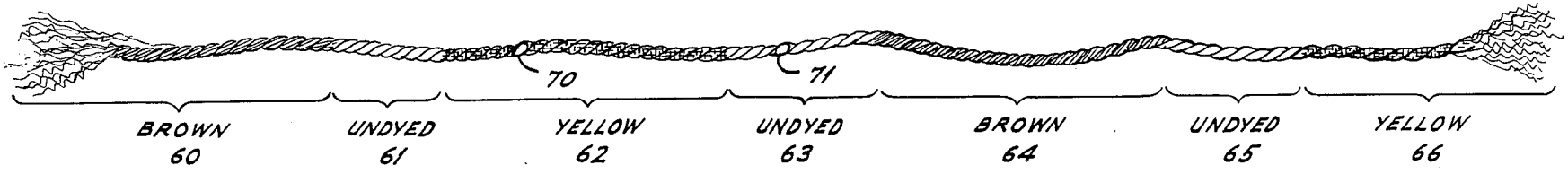
FIG. 9 is a view of a length of yarn produced in accordance with this invention.

The nature of a typical length of yarn 31 produced in accordance with this invention appears in FIG. 9. Specific colors will be referred to only by way of example. This length of yarn 31 includes a brown section 60 of predetermined length, an adjacent length 61 of undyed yarn which length is much shorter than length 60, a length 62 of yellow which is more than twice as long as the length 61, an adjacent length 63 which is undyed and is much shorter than either dyed length 60 or 62, a subsequent brown length 64 which is much longer than length 63 but may be longer or shorter than either length 60 or 62, and so one. As shown in FIG. 9, subsequent undyed length 65 is shorter than any of the lengths 60, 62, 64 or subsequent yellow length 66. It should be noted that it is inherent in the spacedyeing of a knitted fabric that individual spots such as 70 and 71 in FIG. 9 are formed as a result of the particular knitted configuration along the edges of the spacedyed areas. Such random spots should not be considered in evaluating the lengths of the individual colored sections.

It has been discovered that, according to this invention, surprising pattern effects may be achieved by providing yarn wherein the individual color lengths are much greater than the lengths of the individual tufts into which they are intended to be formed, so that several successive tufts possesses the same individual color. Preferably a majority of the colored sections are at least about 6 inches long. However, the color lengths in the yarn should vary at random, to produce a random pattern in the tufted carpet, and this is the result that tends to be produced in the deknitting of a knitted prefabric in accordance with this invention. But it is preferred that the average lengths of color should be greater than the average undyed lengths.

Preferably at least about 20% of the yarn 31 is undyed, and preferably each of the different colored lengths of yarn is separated by an undyed length. It is particularly desirable that successive lengths of different colors, where two different colors A and B are involved, should alternate in substantially the following repeating sequence: Color A, undyed, Color B, undyed, Color A, undyed, etc. Preferably the average length of Color A is about equal to the average length of Color B.

Figure 10:
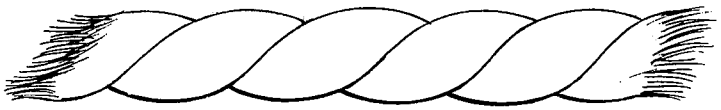
FIG. 10 is an enlarged view of a portion of one form of yarn in accordance with this invention.

FIG. 10 is a view showing a portion of the finished carpet yarn in accordance with one embodiment of this invention, showing its twisted and plied relationship, with one end showing the two piles separated from each other and also showing that in each end of yarn the yarn is composed of a plurality of individual filaments each of which contains a multiplicity of substantially V-shaped crimps.

Accordingly it will be appreciated that a yarn producer may, according to the method of this invention, provide an entire prefabric of drawn but undyed synthetic yarn, can partially spacedye the fabric while having substantial portions undyed, and can then deknit to produce a highly valuable yarn product. Because the initial yarn is undyed it is available in dry form without any drying cost. Because it is not initially pad dyed, as has been the custom, it is dry when the prefabric is presented to the spacedyeing rolls, and thus the cost of drying is saved. Further, because the prefabric is dry the dye does not run after its application by the spacedyeing rolls, and this results in the printing of a sharper image. It also enhances the results when successive sets of spacedyeing rolls are used, as shown in FIG. 1.

It is highly preferred to print at least two different colors on the prefabric, and in some cases the printing of three different colors is preferred.

Because of the surprising features of this invention, the carpet manufacturer realizes very significant advantages. He may order and accept delivery of huge quantities of yarn packages 33 having only a single color combination, and may tuft these into huge quantities of pre-carpet 35 having only a single color combination. It is completely unnecessary to stock large numbers of different color combinations.

Whenever a particular color combination is desired, the carpet manufacturer simply resorts to over-dyeing with a particularly selected over-dyeing color, taking the pre-carpet from stock. Only the required quantity need be over-dyed in order to fill each order. Wide varieties of color combinations can be achieved by selection of the color combinations in the pre-carpet and by selecting the color of the over-dye.

To the best of my knowledge it is quite original to produce a prefabric of drawn but undyed synthetic yarn, dye selected portions of the prefabric while leaving other portions undyed, ravel the yarn from the prefabric, then form the raveled and partially undyed yarn into another prefabric and then substantially completely over-dye the prefabric thus produced. On first consideration there would seem to be no point to the concept of raveling a first prefabric, only to create another prefabric. Yet this is highly advantageous, as will now be apparent.

In my prior U.S. Pat. No. 3,543,359 I disclose the concept of spacedyeing undrawn yarn, and point out the advantages of deep dye penetration that are attained thereby. In such a process it has also been conventional initially to pad dye the prefabric before it is subjected to spacedyeing. It was in this context that I referred to the use of one or more printing or padding stations 27 and 28, and to leaving natural intervening areas unprinted. Such natural intervening areas were not free of dye, but already contained the dye that had been applied to the entire prefabric by the overall preliminary pad dyeing process.

The process of this invention is capable of producing a novel and useful yarn product, a substantial portion of which is free of any dye, and the balance of which consists of random, intermittent dyed lengths consisting of at least two different colors (which may be referred to as Colors A and B) intermittently and randomly arranged along the length of the yarn. As stated, it is preferable that at least 20%, and sometimes at least 50% of the yarn is undyed. This yarn is of itself a useful product, not only for producing pile carpet but for making many other fabrics as well.

Although this invention has been described with reference to certain specific forms thereof, it will be appreciated that various modifications may be made, including changes of sequence of the steps of the method, use of certain features independently of the use of other features, and the substitution of equivalent elements for those shown and described, all without departing from the spirit and scope of the invention as defined in the appended claims.

The following is claimed:

1. In a method of making a fabric from a drawn but undyed synthetic yarn, the steps which comprise:

a. forming a prefabric (a) of said drawn but undyed yarn, b. dyeing selected portions of said prefabric (a) while leaving other selected portions of said prefabric (a) free of any dye, c. raveling the resulting partially dyed prefabric (a) to produce a partially dyed yarn (c), d. forming said partially dyed yarn (c) into a partially dyed prefabric (d), and e. substantially completely over-dyeing the entire surface of said partially dyed prefabric (d) so that at least two different colors are intermittently and randomly arranged along the yarn length.

2. The method defined in claim 1, wherein said prefabric (a) is a knitted prefabric, and wherein said raveling step comprises deknitting.

3. The method defined in claim 1, wherein said prefabric (a) is dry.

4. The method defined in claim 1, wherein said dyeing step (b) includes the dyeing of distinct areas in at least two different colors.

5. The method defined in claim 1, wherein said dyeing step (b) includes the dyeing of distinct areas in at least three diferent colors.

6. The method defined in claim 1, wherein said prefabric produced by step (d) is a tufted pre-carpet.

7. The method defined in claim 1, wherein said over-dyeing step (e) comprises pad dyeing.

8. The method defined in claim 1, wherein said over-dyeing step (e) comprises continuous dyeing.

9. The method defined in claim 1, wherein said over-dyeing step (e) comprises solid screen printing.

10. The method defined in claim 1, wherein said over-dyeing step (e) comprises batch dyeing.

11. The method defined in claim 1, wherein said over-dyeing step (e) comprises vat dyeing.

12. The method defined in claim 1, wherein said knitted prefabric is introduced into dyeing step (b) in a dry condition.

13. The method defined in claim 1, wherein said selected portions which remain undyed in step (b) comprise at least about 20% of the total area of said prefabric (a).

14. Crimped and drawn continuous filament synthetic polymeric yarn a substantial portion of which is undyed, and the balance of which consists of random, intermittent dyed lengths consisting of at least two different colors (A and B) intermittently and randomly arranged along the length of the yarn.

15. The yarn defined in claim 14 wherein at least about 20% of the yarn is undyed.

16. A plied yarn comprising a plurality of yarns as defined in claim 14, plied and twisted to each other.

17. Yarn according to claim 14 wherein substantially each of said different colored lengths of yarn is separated by a length of undyed yarn.

18. Yarn according to claim 14 wherein said successive lengths of different colors alternate substantially in the repeating sequence: Color A, undyed, Color B, undyed, Color A, undyed, etc.

19. Yarn according to claim 18 wherein a majority of said successive lengths are at least about 6 inches long.

20. Yarn according to claim 19 wherein the average length of Color A and Color B is greater than the average length of the intervening undyed portion.

21. Yarn according to claim 20 wherein the average length of Color A is about equal to the average length of Color B.

22. Tufted pile carpet comprising a base having anchored thereto and upstanding from said base a plurality of tufts of yarn as defined in claim 14, said tufts having colors arranged as randomly shaped coherently colored areas.

23. Tufted pile carpet comprising a base having anchored thereto and upstanding from said base a plurality of tufts of yarn as defined in claim 15, said tufts having colors arranged as randomly shaped coherently colored areas.

24. Tufted pile carpet comprising a base having anchored thereto and upstanding from said base a plurality of tufts of yarn as defined in claim 16, said tufts having colors arranged as randomly shaped coherently colored areas.

25. Tufted pile carpet comprising a base having anchored thereto and upstanding from said base a plurality of tufts of yarn as defined in claim 17, said tufts having colors arranged as randomly shaped coherently colored areas.

26. Tufted pile carpet comprising a base having anchored thereto and upstanding from said base a plurality of tufts of yarn as defined in claim 18, said tufts having colors arranged as randomly shaped coherently colored areas.

27. Tufted pile carpet comprising a base having anchored thereto and upstanding from said base a plurality of tufts of yarn as defined in claim 19, said tufts having colors arranged as randomly shaped coherently colored areas.

28. Tufted pile carpet comprising a base having anchored thereto and upstanding from said base a plurality of tufts of yarn as defined in claim 20, said tufts having colors arranged as randomly shaped coherently colored areas.

29. Tufted pile carpet comprising a base having ancored thereto and upstanding from said base a plurality of tufts of yarn as defined in claim 21, said tufts having colors arranged as randomly shaped coherently colored areas.

* * * * *